US005459954A

United States Patent [19]

Bronaugh et al.

[11] Patent Number: 5,459,954

[45] Date of Patent: Oct. 24, 1995

[54] ADVERTISING DISPLAY METHOD AND APPARATUS

[75] Inventors: William R. Bronaugh, Garden Grove; John W. Goodin, Coto de Caza; Roger J. Rickey, Costa Mesa; Bradford D. Peeters, Los Angeles; Gustav Hubert, San Gabriel, all of Calif.

[73] Assignee: Admotion Corporation, Irvine, Calif.

[21] Appl. No.: 114,954

[22] Filed: Aug. 31, 1993

[51] Int. Cl.[6] ..... G09F 11/00

[52] U.S. Cl. ..... 40/476; 40/437

[58] Field of Search ..... 40/436, 437, 442, 40/445, 476, 509, 488

[56] References Cited

U.S. PATENT DOCUMENTS

| | | |
|---|---|---|
| 609,915 | 8/1898 | Sibley . |
| 1,172,360 | 2/1916 | Hildburgh . |
| 1,172,455 | 2/1916 | Hildburgh . |
| 1,322,542 | 11/1919 | Chauvet . |
| 1,594,703 | 8/1926 | Ballerini . |
| 1,938,899 | 12/1933 | Gilman . |
| 2,058,581 | 10/1936 | Fegan . |
| 2,149,779 | 3/1939 | Kroner . |
| 2,151,055 | 3/1939 | Stark . |
| 2,163,188 | 6/1939 | Bosche . |
| 2,263,281 | 11/1941 | Von Radden . |
| 2,605,965 | 8/1952 | Shepherd . |
| 2,645,047 | 7/1953 | O'Gorman . |
| 2,982,038 | 5/1961 | Kass . |
| 2,989,680 | 6/1961 | Weiser et al. . |
| 3,000,125 | 9/1961 | Elvestrom . |
| 3,014,302 | 12/1961 | Hughes . |
| 3,054,203 | 9/1962 | French . |
| 3,082,560 | 3/1963 | Elvestrom . |
| 3,086,306 | 4/1963 | Morgan . |
| 3,110,893 | 11/1963 | Peacock . |
| 3,572,925 | 3/1971 | Ables et al. . |
| 3,613,277 | 10/1971 | Rose et al. . |
| 3,636,552 | 1/1972 | Orima . |
| 3,683,525 | 8/1972 | Fukui . |
| 3,742,631 | 7/1973 | Hasala . |
| 3,747,243 | 7/1973 | Schneider . |
| 3,839,714 | 10/1974 | Janning . |
| 3,862,504 | 1/1975 | Ringelheim et al. . |
| 3,883,966 | 5/1975 | Ludwig . |
| 3,902,901 | 9/1975 | Vogel . |
| 3,914,761 | 10/1975 | Murase et al. . |
| 3,918,185 | 11/1975 | Hasala . |
| 3,953,764 | 4/1976 | Miller et al. . |
| 3,961,434 | 6/1976 | Sampon . |
| 4,050,809 | 9/1977 | Boggs . |
| 4,118,879 | 10/1978 | Simon . |
| 4,216,599 | 8/1980 | Eckert . |
| 4,246,713 | 1/1981 | Eckert . |
| 4,263,737 | 4/1981 | Simon . |
| 4,267,489 | 5/1981 | Morohashi . |
| 4,306,226 | 12/1981 | Swarbrick . |
| 4,491,434 | 1/1985 | Barr et al. . |
| 4,508,802 | 4/1985 | Heiart et al. . |
| 4,542,376 | 9/1985 | Bass et al. . |
| 4,616,327 | 10/1986 | Rosewarne et al. . |
| 4,620,288 | 10/1986 | Welmers . |
| 4,637,974 | 1/1987 | Kubit . |
| 4,897,802 | 1/1990 | Atkinson et al. . |
| 5,100,330 | 3/1992 | Sekiguchi . |

*Primary Examiner*—Brian K. Green
*Attorney, Agent, or Firm*—Fulwider Patton Lee & Utecht

[57] ABSTRACT

A display apparatus having a transparent image screen which contains a mosaic of four discrete images formed from pixels which are interwoven in a predetermined arrangement such that each of the images are selected by precise positioning of the screen in four different positions relative to a grid mask which masks out all but pixels of a selected image. A platen comprising a platen surface which is supported by a rib structure mounts the image screen and is moveable through a precise pattern for selecting the pixels, and thereby the image, to be projected. A pair of arms are coupled to the platen and an eccentric drive and are driven by the eccentric drive to advance the platen positively through the pattern.

18 Claims, 10 Drawing Sheets

ADVERTISING DISPLAY METHOD AND APPARATUS

BACKGROUND OF THE INVENTION

1. Field of the Invention

The present invention relates to advertising, particularly to methods and apparatus for sequentially displaying multiple images in a single display.

2. Description of the Prior Art

With the advent of modern display advertising, limitations on advertising budgets and limited locations for display to high densities of consumers, a great demand has arisen for displaying multiple advertisements at individual popular display locations thereby enabling a number of advertisers to benefit from a single location. Numerous different methods and devices have been proposed for preparing and displaying such advertisements. Many such devices involve relatively unwieldy mechanical elements driven by complex drive mechanisms which require a certain degree of mechanical precision. Thus, in addition to the expense of original manufacture, the user is often faced with expensive maintenance.

In addition, operation of these current drive mechanisms tend to produce an undesirable amount of noise. Typically, these devices are used in public retail outlets or other public locations. The noise level of the drive mechanism frequently predominates over the background music being played at such locations. This noise detracts from the overall environment sought by the retailers at the location where the advertising display is positioned.

It is desirable to have a system that displays multiple images wherein the exchange from one image to another is nearly instantaneous thereby enabling sequential display of different images which gives the impression of animation. Such a sequential display would draw and hold a viewer's attention on what would appear to be an animated advertisement. However, sequential display of multiple images must operate quietly to minimize distraction from the overall environment where the system is located.

Display devices including templates with patterns of apertures which define numbers, letters or figures when they are illuminated by back lighting have been described. See, e.g., Hildburgh, U.S. Pat. No. 1,172,455, and Kass, U.S. Pat. No. 2,982,038. There have also been described display devices including transparency sheets which have images thereon and which are illuminated by back lighting and an overlay mask which blocks the back lighting from illuminating certain areas of the transparency sheets. See, e.g., Elvestrom, U.S. Pat. No. 3,000,125, Fukui, U.S. Pat. No. 3,683,525, and Hasala, U.S. Pat. No. 3,742,631.

In addition, devices have been proposed which include a translucent image screen made up of a mosaic of discrete images formed by relatively small interlaced translucent pixels or window segments which are arranged in uniform groups. The pixels corresponding to a discrete image occupy the same relative position in each group and bear corresponding magnitudes of translucency. The image screen may then be covered with an opaque screen having a uniform pattern of transparent display apertures. The opaque screen blocks back lighting from shining through the image screen except through the display apertures. The uniformly patterned display apertures are then aligned with pixels which correspond to a discrete image and the discrete image is thereby displayed due to the back lighting shining through the image screen and display apertures. The opaque screen may then be selectively shifted on the image screen such that the display apertures align with the pixels of a different discrete image. Thus, each discrete image may be sequentially displayed.

A device of this general description is shown in U.S. Pat. No. 4,897,802 to Atkinson et al., assigned to the assignee of the present application. While the device, as described in that patent exhibits excellent operational characteristics, it is desirable to provide a more economical and reliable drive and registration system which enables convenient and accurate adjustment of registration between the image screen and mask and enables relatively noise free operations.

While these devices are fit for their intended purpose, they do not provide a multiple image advertising display design having low manufacturing tolerances, extended maintenance free operation, and need for only minor on-site adjustments. Furthermore, these devices do not provide sufficiently quiet operation which is desirable for the advertising display to blend in with the overall environment in which it is located.

SUMMARY OF THE INVENTION

The present invention is directed to an advertising display method and apparatus that displays multiple images wherein the exchange from one image to another is fast, accurate, and quiet. The image exchange of the present invention enables sequential display of different images which can give the impression of animation.

The present invention preferably includes a back-lit translucent image screen having a mosaic of pixels comprising discrete composite images and having an overlying opaque mask sheet having a plurality of display apertures. The image screen comprises pixels of a discrete image interspersed with pixels of other discrete images. The pixels are arranged in uniform groups of pixels such that pixels from any one image are located in corresponding positions in each group. The pixels are generally themselves polygonal and may be arranged in polygonal groups to define rhomboid or, preferably, square shapes. The apertures in the mask sheet comprise corresponding rhomboid or, preferably, square shapes.

The images are displayed by relative movement between the image screen and the overlying opaque mask sheet such that the display apertures of the mask sheet align with pixels corresponding to a particular image to be displayed. When the image screen is illuminated from its back side the opaque mask sheet blocks light from projecting through the body of the image screen except for the pixels aligned with the apertures. Thus, when the apertures in the mask sheet register over a specific set of pixels, a discrete image comprising a composite of the illuminated pixels is displayed.

The present embodiment also includes a platen upon which the translucent image screen is adjustably mounted. The platen is preferably formed with a central cylindrically shaped convex curved rib structure to support the image screen. The curved surface allows the overlying mask sheet to be biased down at its edges to be drawn into intimate contact with the central portion of the image screen. The platen is movably attached to a housing (or display box) which has a light mounted therein such that the screen or sheet mounted on the platen may be back-lit. The platen is restricted in movement relative to the housing by a plurality of stops. The stops restrain movement of the platen to within a certain boundary. As described below, the platen moves the translucent image screen in discrete steps with respect to the opaque mask sheet, or vice versa, such that the pixels on the image screen register with the apertures of the mask sheet at the end of travel for each step.

The present invention also includes a driver attached to the display apparatus. The driver has an eccentric cam which engages a pair of cam arms which are attached to the platen. The platen is moved by the interaction of the eccentric cam and the cam arms such that the stops limit the extent of the platen's travel. The stops are positioned such that the travel of the platen is limited and stopped in a position where the pixels on the image screen are aligned with the apertures in the mask sheet thereby enabling display of one of the discrete images on the screen. In addition, the apparatus is provided with features which enable adjustment of the relative positioning of the mask sheet and the image screen to provide proper alignment between the mask sheet and image screen. Once proper alignment is achieved, shifting the image screen through predetermined positions relative to the central mask sheet, or vice versa, will serve to selectively display the discrete images by screening out all light being projected through the image screen except for the light being projected through the pixels of the discrete image being displayed.

Other objects and features of this invention will become apparent from consideration of the following description taken in connection with the accompanying drawings.

DETAILED DESCRIPTION OF THE PREFERRED EMBODIMENT

Figure 1:
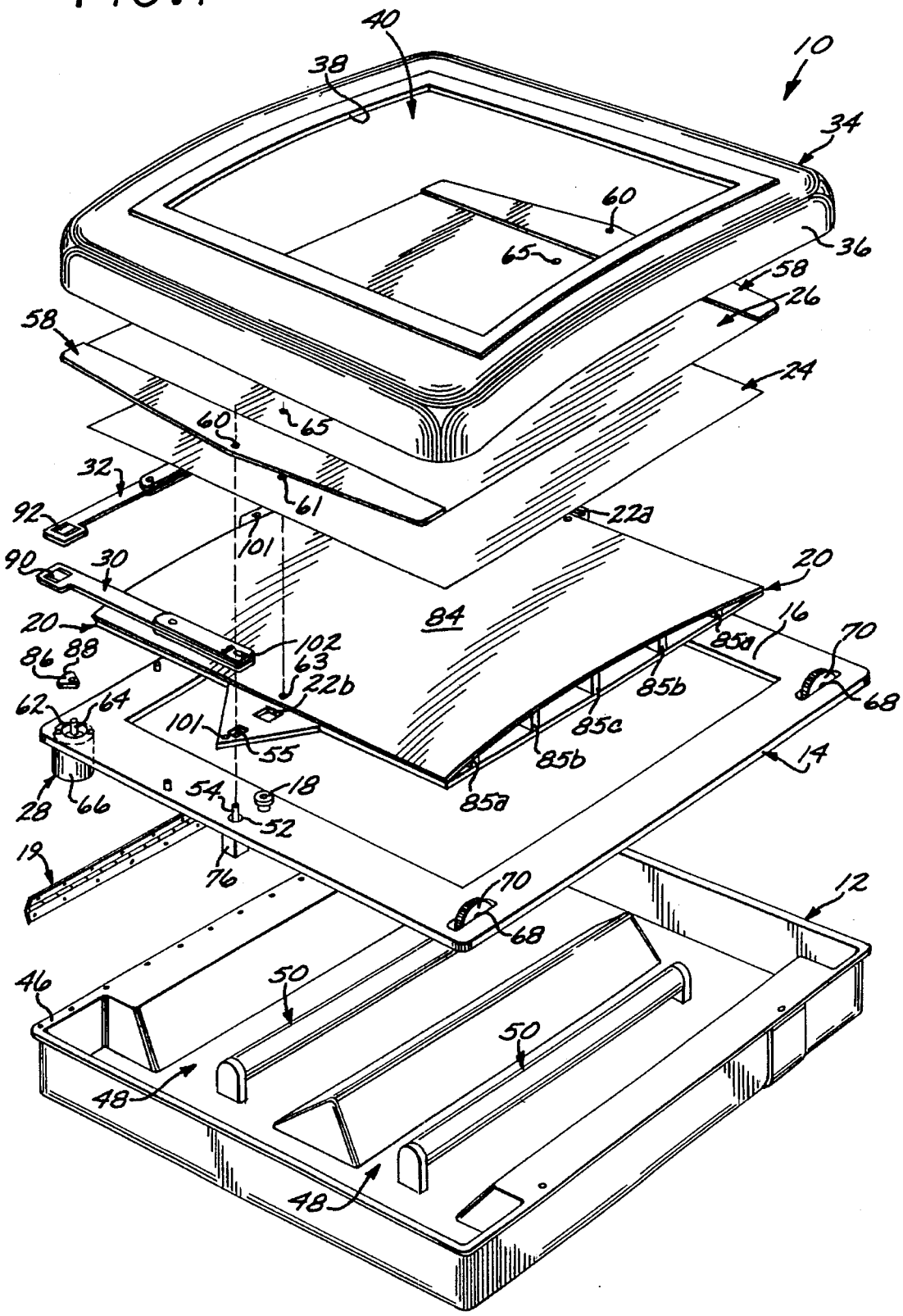
FIG. 1 is an exploded perspective view of a first embodiment of display apparatus of the present invention.

Referring to the drawings, particularly FIGS. 1–6, the preferred embodiment of the display apparatus of the present invention 10 includes, generally, an open, top housing 12 upon which is mounted a generally square frame defining a border 14. The frame 14 provides an outwardly facing generally planar surface 16 (FIGS. 1 and 3) having centrally positioned along top and bottom edges thereof respective stop blocks 18. The stop block 18 is shown as being generally circular, but it could be of any workable shape (FIGS. 1, 2, 3 and 5). A hinge 19 provides a connection between the housing 12 and the frame 14 along one side. The hinge 19 enables easy access to the interior of the housing 12.

Figure 2:
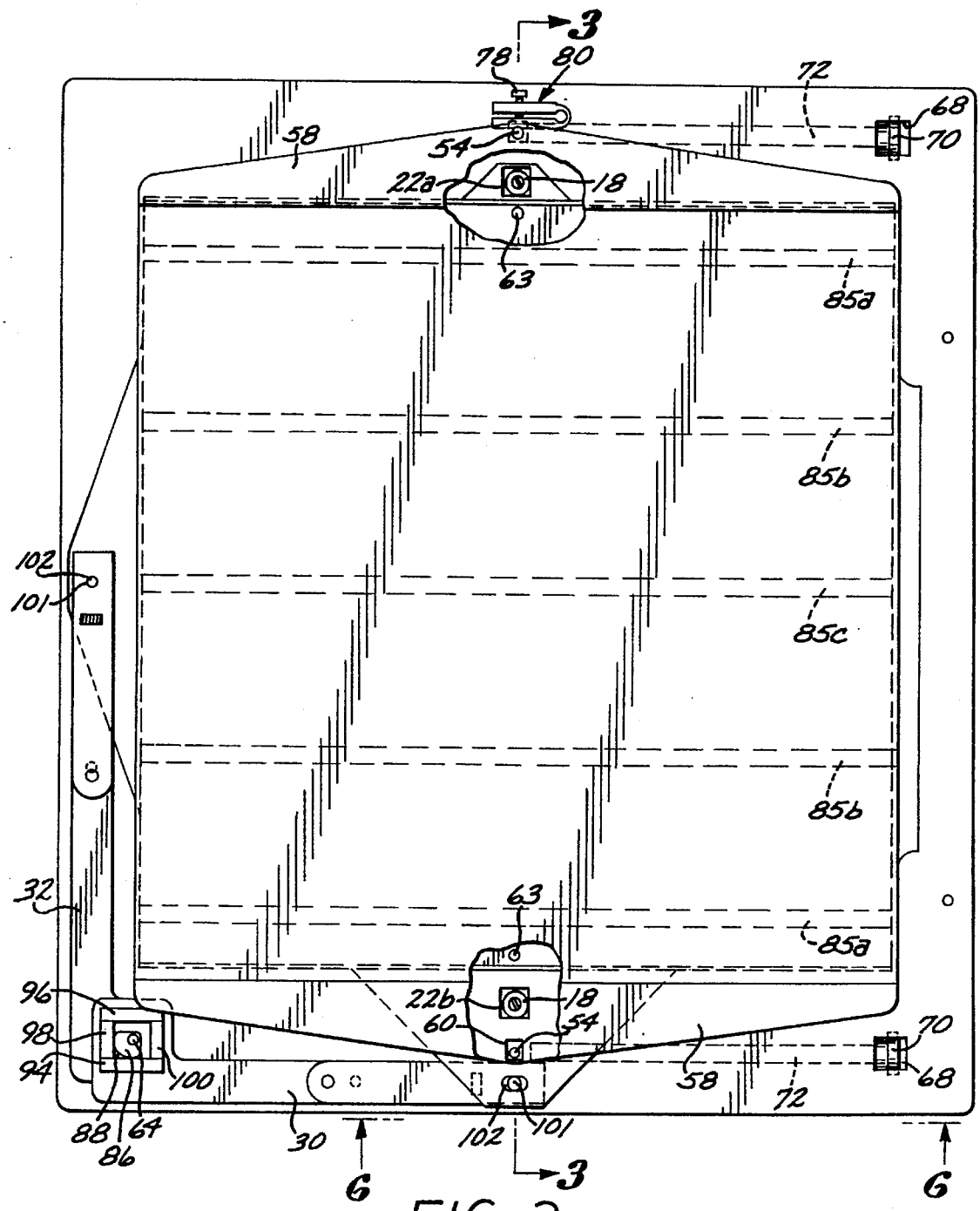
FIG. 2 is a top plan view with a partial cut away of the display apparatus shown in FIG. 1 with the bezel removed.

Referring to FIGS. 1 and 2, a rectangular in plan view platen 20 is shiftably mounted on the planar outwardly facing surface 16 of the frame 14. The platen 20 includes respective triangular tether tabs disposed centrally along its respective top and bottom edges thereof to be formed with respective generally square stop block apertures **22*a* and 22*b* (FIGS. 1, 2, 3 and 5) for receipt of the respective stop blocks 18 of the frame 14. As shown in FIGS. 16–19, the walls of the respective stop block apertures 22*a* and 22*b* limit the possible movement of the respective stop blocks 18 and thereby limit movement of the platen 20 on the frame 14. The stop blocks 18 and respective stop block apertures 22*a* and 22*b* are sized such that the movement of the platen 20 is limited to approximately one-half (½) millimeter in any one of four orthogonal directions (i.e. left (FIG. 16), down (FIG. 17), right (FIG. 18), and up (FIG. 19)) and, therefore, limited to one (1) millimeter total either vertically or horizontally. It is preferable that the top block aperture 22*a* which controls the vertical travel (generally the stop block aperture 22*a* is at the top of the device 10 when mounted in a vertical orientation shown in FIG. 3.) is precisely sized and that the other stop block aperture 22*b* (generally the stop block aperture 22*b* is at the bottom of the device 10 when in use) be oversized in vertical height so as not to constrain travel of the platen 20 in a vertical direction. By having the bottom stop block aperture 22*b* oversized in this way, the top aperture 22*a* provides the sole control of vertical travel thereby preventing differential thermal coefficients of expansion from reducing the vertical travel as the temperature changes. Formed distally of the respective apertures 22*a* and 22*b* are respective clearance windows aligned with the respective posts 54**.

Mounted in stacked relation on the platen 20 is an image screen 24 which is shifted with the platen 20 relative to an overlying screening mask 26 for the purpose of selectively screening out certain portions of the screen 24 to provide for projection through other portions thereof. Although it is preferable that the platen 20 carry the image screen 24 and move it relative to the mask 26, the platen 20 could carry the mask 26 and move it relative to the screen 24. Coupled between the platen 20 and the frame 14 is an eccentric drive mechanism 28 (FIG. 1) for driving orthogonal coupling arms 30 and 32 to sequentially shift the platen 20, and consequently the image screen 24, about a path to four extreme positions defined by the limits of the walls of the stop block apertures 22*a* and 22*b* confining movement of the stop blocks 18 (see FIGS. 16–19).

Figure 3:
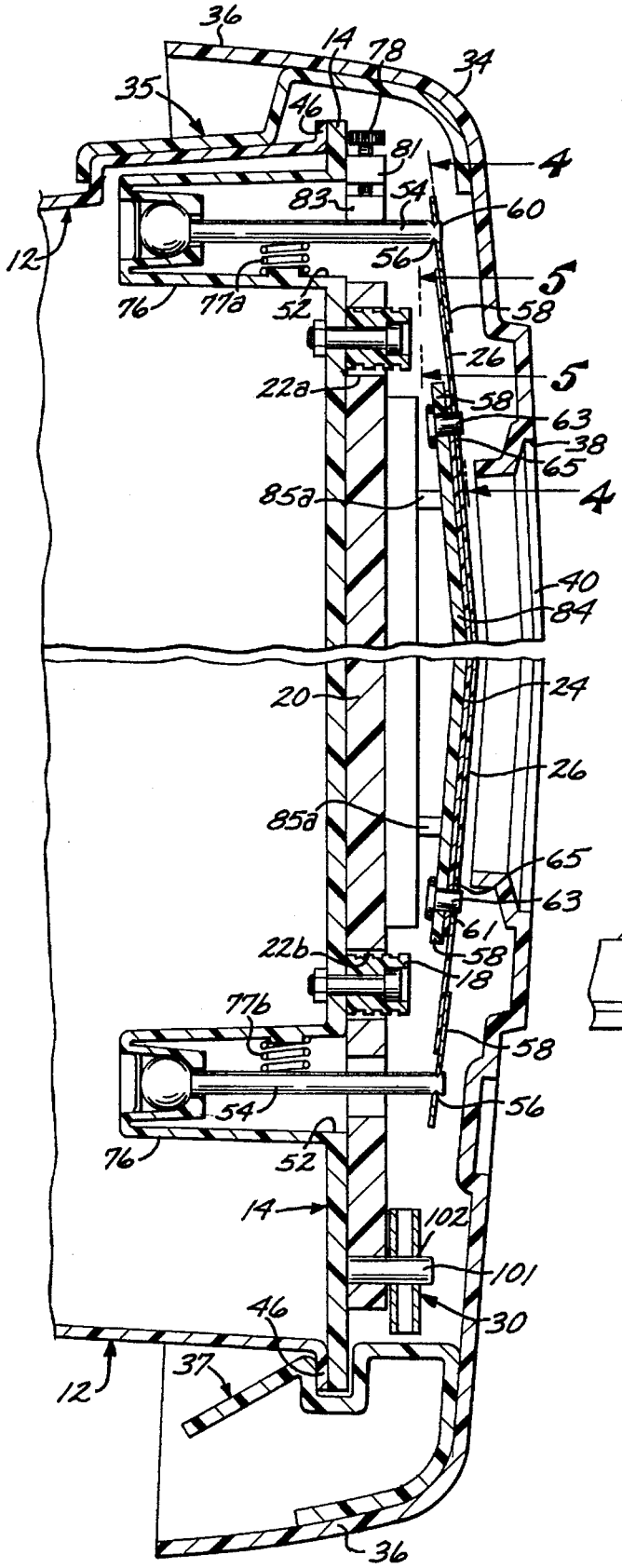
FIG. 3 is a cross sectional view taken along line 3—3 of FIG. 2 with the bezel in place.

Referring to FIGS. 1 and 3, a bezel 34 comprises a generally square rim which overlies the top sides of the peripheral edges of the platen 20 and housing 12 and is constructed with a downwardly and outwardly flared peripheral skirt 36. The bezel 34 is formed with a centrally positioned plate aperture 38 which may have mounted therein a transparent plastic protective plate 40. Referring to FIG. 3, the bezel 34 is mounted on the housing 12 by means of a hook 35 and squeeze spring arrangement generally designated 37. The hook 35 is somewhat Z shaped, projecting rearwardly from the interior of the bezel 34 near its top edge and turned inwardly on its distal extremity to hook over the rear lip in the housing 12 to limit downward movement of such bezel relative to such housing. The squeeze spring 37 is mounted interior of the bezel 34 near its bottom edge and projects rearwardly to be formed with a turned back clasp biased upwardly to span the combined peripheral lip 46 of the housing 12 and marginal edge of the frame 14 and then tapers rearwardly and downwardly to form a finger grasp. To remove the bezel 34 from the housing 12, the squeeze spring 37 is pulled toward the lower run of the skirt 36 (FIG. 3) of the bezel 34 thereby detaching the spring 37 from engagement with the housing 12 and frame 14.

In practice, the device of the present invention 10 is typically suspended in a generally vertical plane with the device 10 positioned such that the edge of the device 10 nearest the viewer in FIG. 2 is in a bottom position.

The image screen 24 may be fabricated in any desirable well-known manner such that the screen 24 comprises interlaced sets of pixels wherein each set of pixels comprises a composite image when light is transmitted therethrough. The screening mask 26 may also be fabricated in any desirable well-known manner such that the mask 26 is opaque and has a plurality of apertures or transparent windows which are positioned and sized to correspond to the individual sets of pixels. The pixels of each set of pixels on the image screen 24 are interlaced and positioned in groups wherein each group contains a pixel which corresponds to each set. The apertures of the mask 26 are spaced and sized such that they may be precisely positioned over any one set of pixels such that light may be projected therethrough to display the set of pixels and thereby the corresponding composite image. Arrangements like this are well-known and described in U.S. Pat. No. 4,897,802 to Atkinson et al., so that no further description is required here. The mask 26 includes clearance apertures 65 (FIGS. 1, 3 and 4) aligned over the respective registration pins 63.

As shown in FIG. 1, the housing 12 is generally pan-shaped and substantially rectangular in plan view. The housing 12 is formed with the peripheral edge flange 46 (FIGS. 1 and 3) and has an integrally molded pair of side by side elongated reflective channels 48 (FIG. 1) configured to centrally receive fluorescent lighting tubes 50. The reflective channels 48 reflect light produced by the lighting tubes 50 to the image screen 24.

Figure 6:
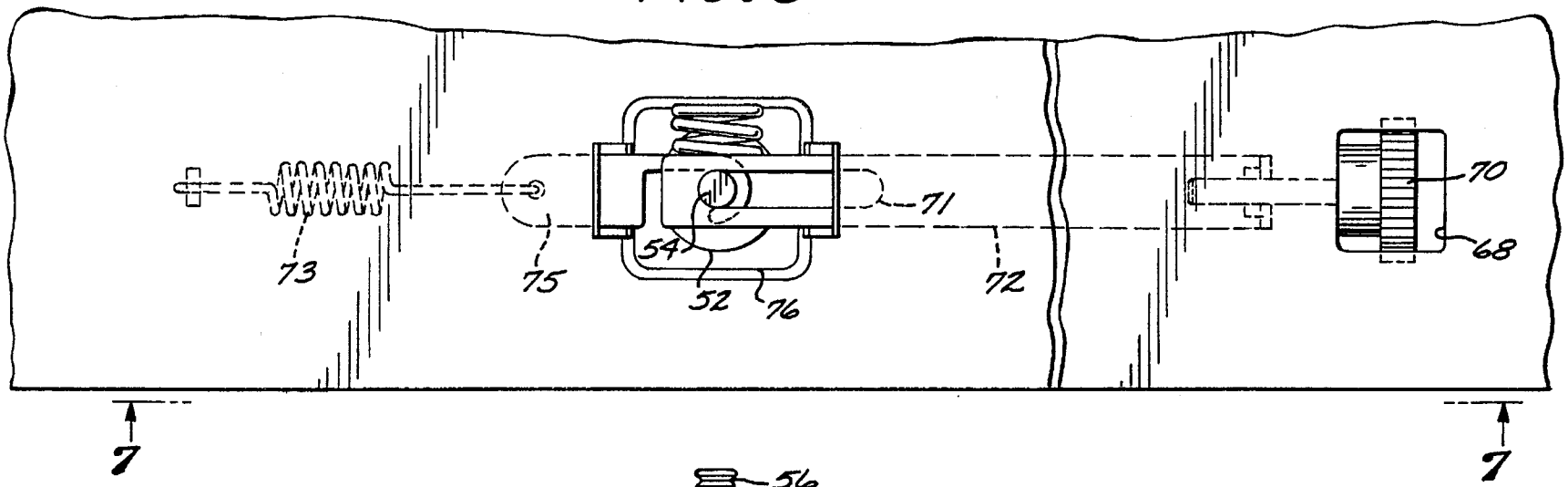
FIG. 6 is a view taken along line 6—6 of FIG. 2.
Figure 7:
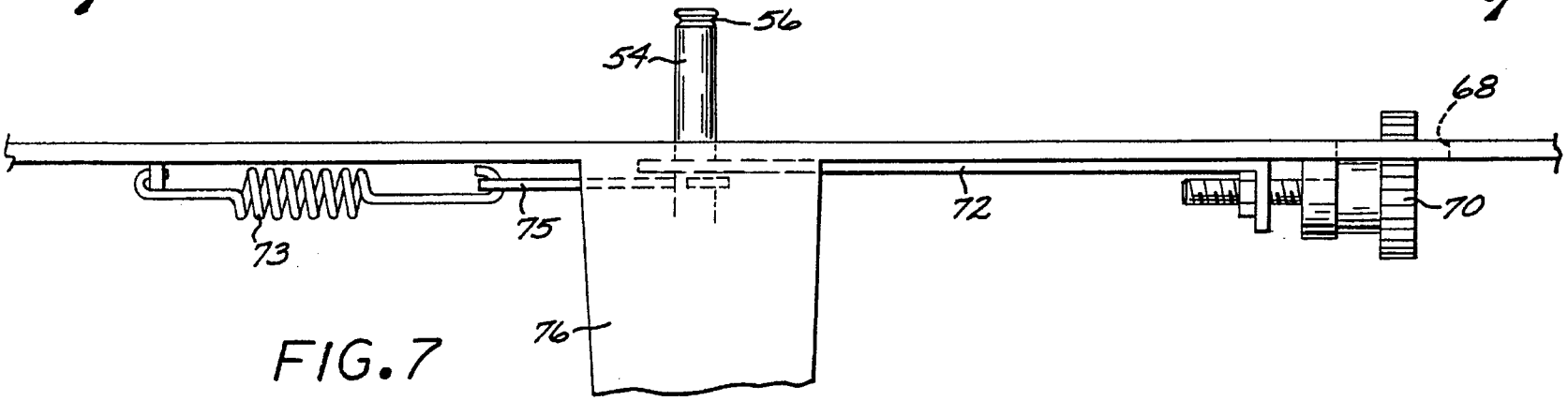
FIG. 7 is a view taken along line 7—7 of FIG. 6.

The frame 14 includes attachment post apertures 52 centrally positioned along the respective top and bottom runs (FIGS. 1, 3 and 6) for projection outwardly therethrough of the projecting ends of respective posts 54 pivotally carried on their back ends in respective cup shaped post housings 76 to be biased longitudinally upwardly and downwardly, respectively, by respective coil compression springs 77*a* and 77*b* (FIG. 3). Similarly, the platen includes attachment post clearance apertures 55 aligned over the respective frame apertures 52. The clearance apertures 55 are sized to accommodate the adjustment posts 54 which extend therethrough such that the posts 54 do not contact the edges during movement of the stop blocks 18 in relation to the stop apertures 22. The attachment posts 54 include respective circumferential grooves 56 around the top ends thereof (FIGS. 3 and 7). Extended from the top and bottom marginal edges of the screening mask 26 are triangular shaped attachment bindings 58 (FIGS. 1–4). The attachment bindings 58 include centrally positioned apertures 60 (FIGS. 1 and 4) which engage the grooves 56 (FIG. 3) of the attachment posts 54 and thereby hold the mask 26 to the frame 14. As shown in FIGS. 1 and 3, the image screen 24 includes centrally positioned along both its top and bottom edges a registration aperture 61 (FIG. 1). The apertures 61 are generally sized and positioned to fit over respective registration pins 63 disposed on the opposite ends of the platen 20 in alignment with the respective apertures 22*a* and 22*b*. It is preferable that the apertures 61 be sized such that the aperture at the top of the screen 24 fits tightly around its associated registration pin 63 to establish vertical and horizontal positioning of the screen 24 on the platen 20. It is also preferable that the aperture 61 at the bottom of the screen 24 fit on its associated registration pin 63 such that the horizontal movement of the screen 24 is more limited than the vertical movement. The aperture 61 and pin 63 arrangement enables the image screen 24 to be moved relative to the mask 26 and prevents the image screen 24 from rotating around the registration pin 63 at the top of the platen 20.

As shown in FIG. 1, the frame 14 is formed in one corner with a clearance opening 62 having the drive mechanism mounted thereunder. Such drive mechanism includes a driving motor 66 having a drive shaft 64 projecting upwardly through the clearance hole 62 to mount thereon a wedge shaped drive cam 86 having an arcuate cam surface thereon. The frame 14 also includes a pair of aligned elongated clearance notches 68 at the opposite ends of one side (FIGS. 1, 2 and 6). Knurled thumb wheels 70 are carried on respective axial threaded shafts journaled through respective mounting brackets on the bottom side of such frame (FIG. 7) such that the respective upper sectors thereof project through such clearance slots.

The clarity of the images being shown by light projecting through pixels of the image screen 24 may be adjusted by adjusting the positioning of the mask 26 vertically or horizontally relative to the image screen 24. Referring to FIGS. 6 and 7, the posts 54 are engaged medially by the turn back of a hook 75 to be biased to one side by a coil spring 73 connecting such hook to the frame 14 and an elongated slot 71 in one end of a link 72 connected on its opposite end to a thumb wheel 70. The spring 73 and connector plate 75 arrangement provides tension to maintain the attachment/adjustment post 54 at the end of the slot 71 in the adjustment shaft 72 so that the adjustment link 72 controls the lateral position of the top end of the adjustment post 54 and hence the mask 26.

Figure 4:
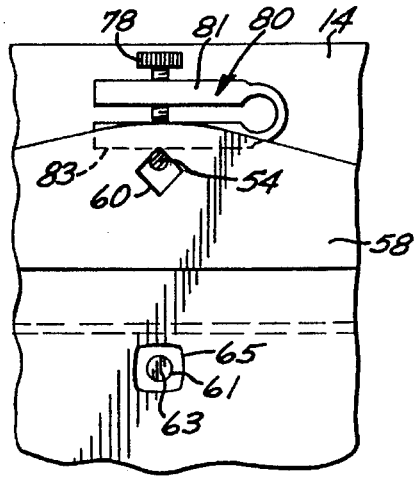
FIGS. 4 is a partial view taken along line 4—4 of FIG. 3 with the bezel in place.
Figure 5:
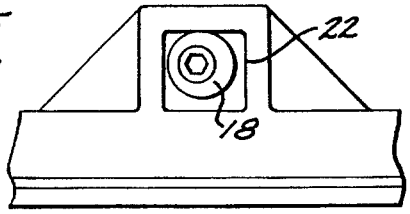
FIG. 5 is partial view taken along line 5—5 of FIG. 3.

Referring to FIGS. 2, 3 and 4, a U shaped adjustment clip spring 80 is mounted to the top of the frame 14 adjacent the top post 54 and is formed by a mount leg 81 and an adjustment leg 83. A vertical adjust knob 78 is carried on one end of a threaded shaft screwed through a threaded bore in the leg 81 to abut on its free end against the leg 83 to selectively urge it against post 34 (FIG. 4) to, upon manipulation, adjust the position of post 54 (up and down) thereby adjusting the vertical positioning of the mask 26. Referring to FIG. 3, the upper bias spring 77*a* is preferably stronger than the lower bias spring 77*b* to provide a greater spring constant and prevents the bias of the lower spring 77*b* from overcoming the bias of the upper spring 77*a* and pulling the upper adjustment post 54 away from the adjustment clip spring 80. This enables the clip spring 80 to remain in control of the up and down positioning of the upper adjustment post 54 and, thus, the mask 26. The function of the upper bias spring 77*a* is to hold the adjustment post 54 firmly in contact with the clip spring 80. The function of the lower bias spring 77*b* is to provide tension to hold the mask 26 securely in place between the two adjustment posts 54.

Figure 3A:
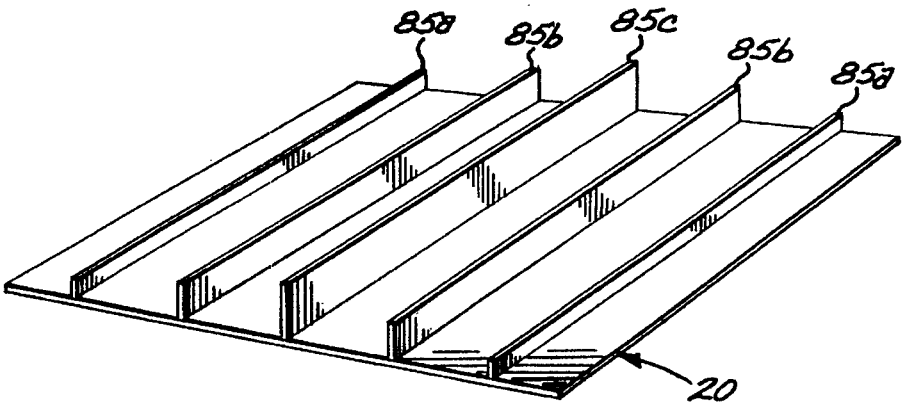
FIG. 3A is a perspective view of a rib structure for supporting the curved surface of the platen.
Figure 3B:
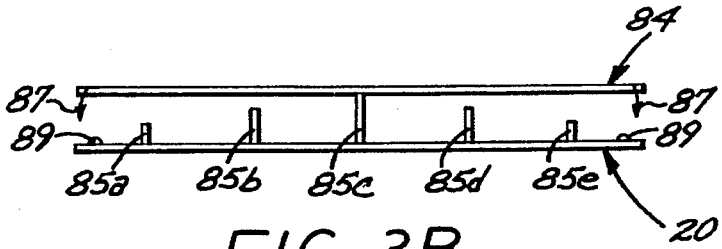
FIG. 3B is an end view of the rib structure.
Figure 3C:
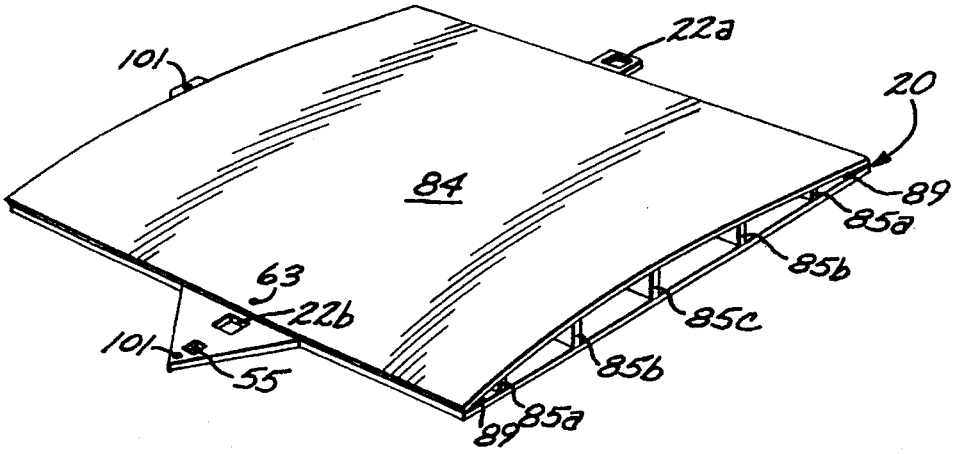
FIG. 3C is a perspective view of the platen incorporating the rib structure.

The platen 20 is preferably formed with a central cylindrical curved surface 84 (FIGS. 1 and 3), which is preferably supported by a rib structure (FIGS. 3A, 3B and 3C). The rib structure has horizontally disposed upper and lower ribs 85*a*, medial ribs 85*b*, and a central rib 85*c* secured to the base of the platen 20. The respective upper and lower ribs 85*a* are of a first short height, medial ribs 85*b* are taller, and a center rib 85*c* is still taller. Using ribs 85 of different heights in this manner allows the platen surface 84 to be attached thereto in a manner to deflect it to the desired curvature. Importantly, the platen surface 84 is secured (as by gluing) only to the center tallest rib 85*c*. When the image screen 24 is mounted to the platen 20, as described above, the platen surface 84 arcs downwardly (as shown by arrows 87 in FIG. 3B) to rest against the ribs 85*a* and 85*b* to provide the desired curved shape to the platen surface 84. The benefit of this arrangement is that it minimizes any bowing of the platen surface 84 between the ribs 85*a* and 85*b*, 85*b* and 85*c*, 85*c* and 85*b*, and 85*b* and 85*a*, and, therefore, allows the image screen 24 and mask 26 to lie together in very close contact and to achieve more accurate registration.

The rib structure and platen surface 84 thereby provide a curved support surface for support of the image screen 24 to be held in position by the mask 26 and by the post 54 as described above. Referring to FIG. 3, it is clear that the reception of the apertures 60 of the binding 58 of the mask 26 onto the grooves 56 of the attachment/adjustment posts 54 draws the mask 26 firmly down over the platen surface 84 thereby pulling the platen surface 84 into a curved position and pulling the mask into intimate contact with the image screen 24 to thereby help positively retain the image screen 24 in contact with the cylindrically curved surface 84. This intimate contact facilitates a close spaced relationship between the image screen 24 and the mask 26 such that, upon precise alignment between the apertures of the mask 26 and image pixels of the screen 24, light will be projected precisely through the apertures and aligned pixels to thereby prevent what is termed parallax or other unwanted distortion of the projected light.

The platen 20 is typically constructed of a hard plastic, such as acrylic, having sufficient rigidity to maintain its generally square shape in plan view (see FIGS. 1 and 3C) and having a low coefficient of friction to facilitate freedom of movement on the surface 16 of the frame 14. As described above, movement of the platen 20 is limited by the interaction of the stop blocks 18 and the stop block apertures 22.

Turning now to the mechanism for controlling movement of the platen 20 (FIGS. 1, 2 and 8–11) the drive cam 86 (FIG. 2) is disposed to be rotatably received within generally square-shaped apertures 90 and 92 formed in the respective proximate ends of each of the coupling arms 30 and 32, respectively. The coupling arms 30 and 32 include drive apertures 102 at ends opposite the apertures 90 and 92 (FIGS. 1 and 3). The coupling arms 30 and 32 are drivingly linked to the platen 20 by engaging drive posts 101 with drive apertures 102 of coupling arms (FIGS. 1, 2, 3 and 12). The coupling arms 30 and 32 are disposed substantially perpendicular to each other with the apertures 90 and 92 overlying one another as shown in FIGS. 1 and 2. The apertures 90 and 92 are shown in FIGS. 8–11 in an expanded view with one aperture located adjacent the other for the purposes of simplifying the explanation of operation. The cam 86 must be constructed of sufficient thickness to project into both apertures 90 and 92 when the arms 30 and 32 are overlying one another.

Referring to FIGS. 8–11, the aperture 90 of the horizontally disposed arm 30 includes parallel follower slides 94 and 96 on opposite horizontal edges of the aperture 90. The follower slides 94 and 96 are preferably constructed of Teflon or other low-friction material. The follower slides 94 and 96 are contacted by the arcuate surface 88 of the cam 86 to drive the arm 30 up and down. The aperture 92 of the vertically disposed arm 32 includes low-friction parallel follower slides 98 and 100 on opposite vertical edges of the aperture 92. The follower slides 98 and 100 are also preferably constructed of Teflon or other low-friction material and are contacted by the arcuate surface 88 of the cam 86 to drive the arm 32 right and left. As shown in FIGS. 8–11, the arcuate cam surface 88 may sequentially contact the follower slides 94, 96, 98 and 100 to move the arms 30 and 32 and thereby move the platen 20.

Figures 8, 9, 10, 11, 12, 13, 14, 15:
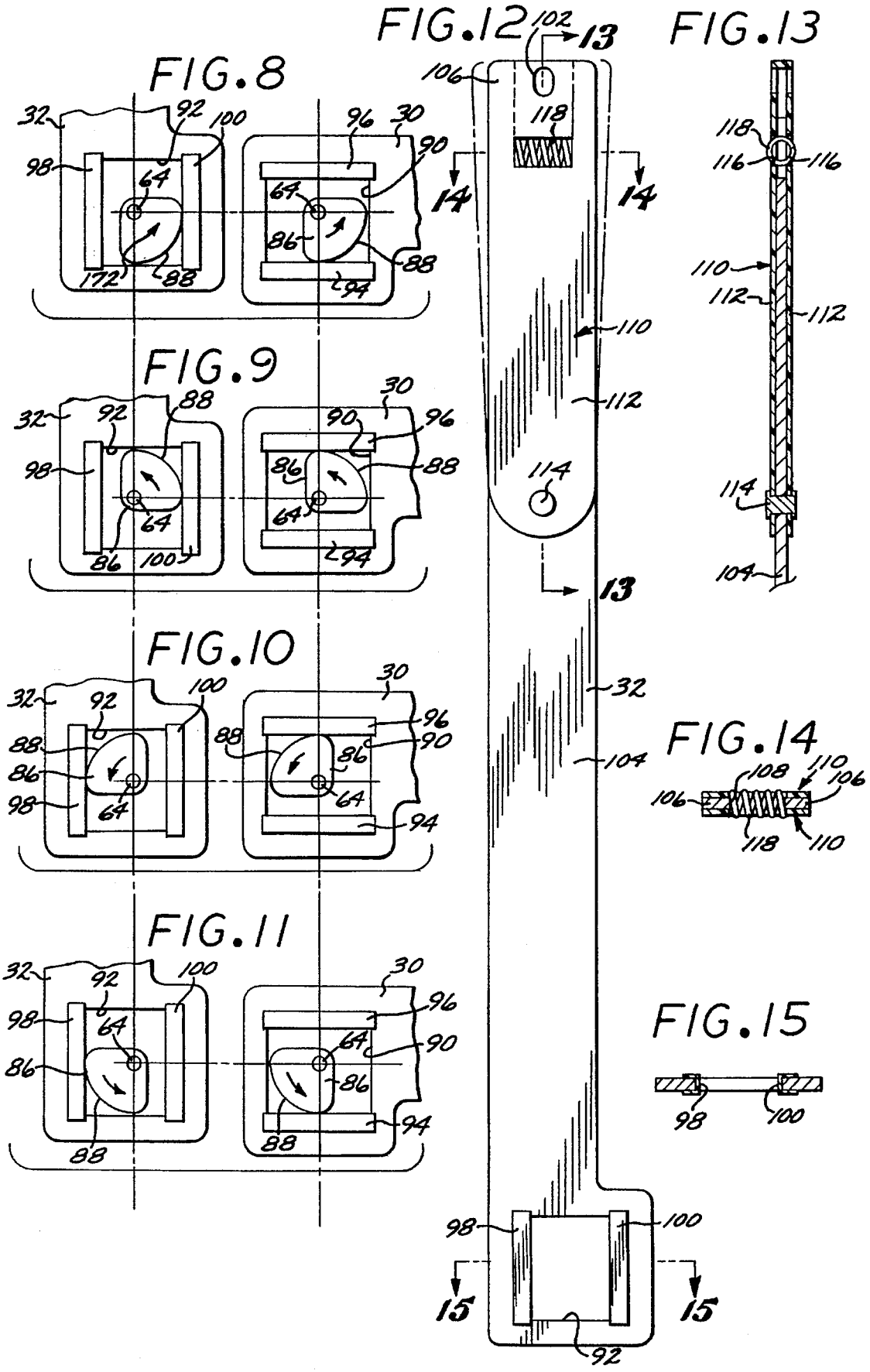
FIGS. 8–11 are expanded diagrammatic views of the cam and cam stops of the present invention showing the cam in four different positions respectively.
FIGS. 12 is a detailed view of a cam arm of the present invention.
FIG. 13 is a cross sectional view taken along line 13—13 of FIG. 12.
FIG. 14 is a cross sectional view taken along line 14–14 of FIG. 12.
FIG. 15 is a cross sectional view taken along line 15—15 of FIG. 12.

The same general description applies to arm 30 as both arms 30 and 32 are of similar construction. As shown in FIGS. 12 and 14, arm 32 includes a rigid stem 104 which at one end (the end opposite the aperture 92) is forked to define a pair of flat tines 106 formed with an opening 108 therebetween (FIGS. 12 (dashed lines) and 14). Mounted over the forked end of the stem 104 is an over-travel bracket 110 (FIG. 13). The bracket 110 is generally U-shaped to form opposed, spaced apart flat tines 112 which sandwich therebetween the forked end of the stem 104 (FIGS. 13 and 14). The over-travel bracket 110 is pivotally connected to the stem 104 by means of a pivot pin 114 (FIGS. 12 and 13). Pivot pins 114 are also used to connect the arms 30 and 32 to the frame 14.

Formed in the flat tines 112 of the over-travel bracket 110 are aligned transverse slots 116 disposed in general alignment with the opening 108 between the tines 106 of the stem 104 (FIGS. 13 and 14). Releasably received and retained in the slots 116 is a coil compression spring 118 (FIGS. 12–14). The spring 118 is retained in the opening 108 between the tines 106 such that the bracket 110 is biased to a central neutral position (as shown by solid lines in FIG. 12). As mentioned above, arm 30 is of construction similar to that of arm 32.

In operation, the present embodiment of the invention is typically supplied to an advertising agency or leasing entity and the image screen 24 is prepared to provide a desired mosaic of images with corresponding pixels oriented and configured in a manner which is known to those skilled in the art. In practice, for the preferred embodiment, the pixels are approximately one (1) millimeter or 0.03937 inches square and the image displayed is approximately 18 to 50 inches wide and 18 to 50 inches tall. This size provides a pleasing display for the viewer. However, other sizes may be acceptable. The image screen 24 preferably comprises pixels arranged in a square pattern thereby requiring the screen 24 and platen 20 to be moved through a one (1) millimeter by one (1) millimeter square pattern (e.g. one millimeter to the right, one millimeter down, one millimeter to the left, and one millimeter up). If the pixels are of a different size and/or shape, the pattern of movement will be different. In this embodiment, the stop blocks 18 are mounted on the frame 14 such that the platen may move one (1) millimeter total in both the transverse and longitudinal directions.

The motor 66 may be energized to move the platen 20 to a position such that the apertures 22 of the platen 20 engage the stop blocks 18 of the frame 14 (FIGS. 16–19). Generally, the stop blocks 18 will engage two sides of the substantially square apertures 22. For example, when the platen 20 is moved to an upper left position, the lower and right sides of the apertures 22 are engaged (see FIG. 16). When the platen 20 and, consequently, the screen 24 are positioned, the relative position of the mask 26 may easily be adjusted using wheels 70 and 78 to assure proper registration between the mask 26 and screen 24 such that the pixels of the screen 24 are aligned with the apertures of the mask 26 to thereby provide for projection of a high quality composite image. A transverse adjustment of the mask 26 may be easily achieved by, for instance, adjusting the thumb wheels 70 of the adjustment shafts 72 to advance or retract the adjustment post housings 74 to thereby shift the mask 26 transversely as required for appropriate alignment. In a similar manner, a longitudinal adjustment may be achieved by adjusting wheel 78 (FIG. 2) to pivot the leg 83 of the clip spring 80 to raise or lower the adjustment post 54 and thereby shift the mask 26. The adjustment shafts 72 may be made of material which will not inadvertently shift the mask 26 (e.g. when exposed to an increase in temperature). The shafts 72 are preferably made from the same material as the frame 14. Acceptable material includes steel. Thus, if the temperature changes, the expansion or contraction of the frame 14 and the adjustment shafts 72 will be the same, and there will be no net shift of the adjustment posts 54 or the mask 26. Once adjustment has been made, the bezel 34 may be conveniently snapped in position over the mask 26 and to the housing 12 as described above.

Once everything is adjusted, the motor 66 may be energized to thereby rotate the cam 86 and move the platen 20. The cam 86 moves the platen 20 and, consequently, the image screen 24 as the cam 86 engages the follower slides 94, 96, 98 and 100 of the coupling arms 30 and 32. The platen 20 is moved through a pattern while the stop blocks 18 remain within the confines of the stop block apertures 22.

Figure 18:
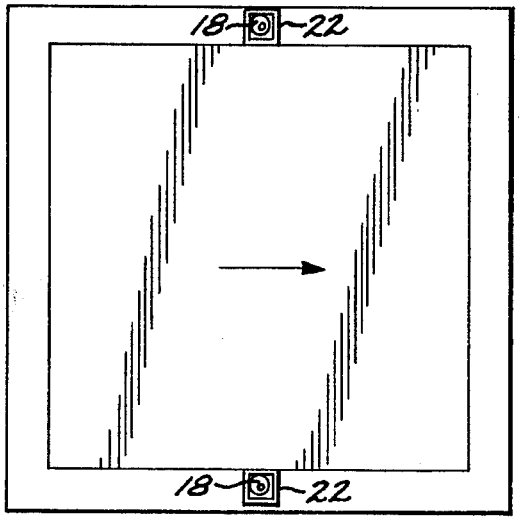

Turning to the platen 20 movement in more detail, FIGS. 8–11 show the cam 86 in various states of rotation. FIG. 8 shows the cam 86 as it rotates counterclockwise and engages follower slides 94 and 100 the arms 30 and 32 will be driven down and to the right thereby driving the platen 20 and, consequently, the image screen 24 to the upper left (due to the arms 30 and 32 rotating around pivot pins 114). The platen 20 will travel to the upper left until the stop blocks 18 contact the limits of the apertures 22 (FIG. 18).

The drive linkage is constructed with some override. Thus, the cam 86 is constructed to drive the arms 30 and 32 slightly greater distances than that necessary for the platen 20 to make the stop blocks 18 contact the side of the stop block apertures 22. This assures positive registration between the mask 26 and the screen 24. Once contact is made between the platen 20 and the stop blocks 18, the bracket 110 of the coupling arm 32 will discontinue travel to the left, but the rigid stem 104 will continue to travel due to the force of drive cam 86 on the follower slide 100. As a consequence, the over-travel bracket 110 will stop even though the stub arm 104 continues to pivot slightly counterclockwise about the pivot pin 114 (FIG. 12). The pivoting movement will be lightly resisted by the compression coil spring 118 compressing between the tine 106 and the slots 116 (FIGS. 13 and 14).

Figure 16:
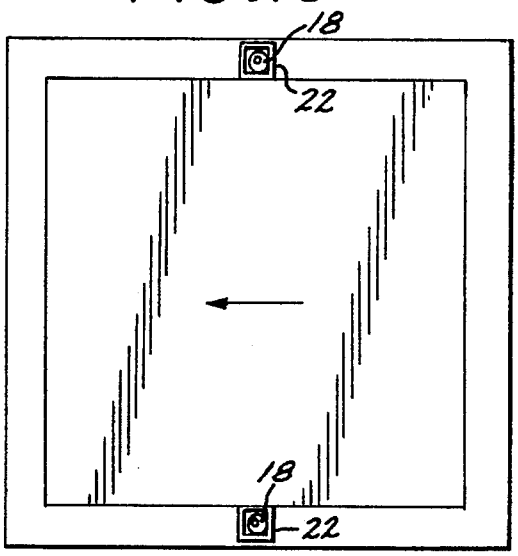
FIGS. 16–19 are diagrammatic views showing platen stop blocks of the present invention in four different positions with respect to stop edges.
Figure 17:
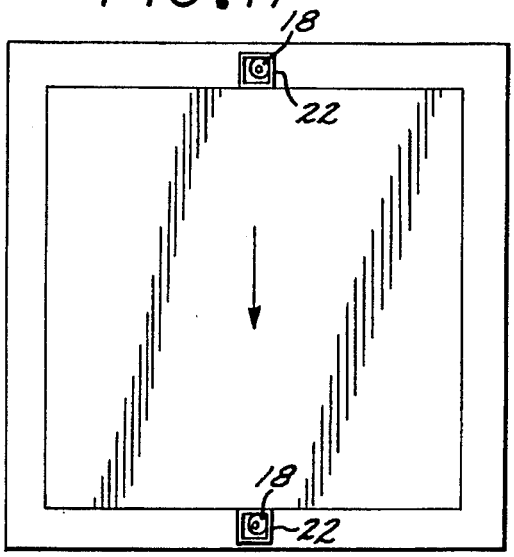

Meanwhile, the arcuate cam surface 88 of the cam 86 has maintained contact with follower slide 94 of arm 30 (FIG. 8) thereby maintaining the stop blocks 18 along the bottom edge of the apertures 22 (FIG. 16). It will be appreciated by those skilled in the art that the timing circuit (not shown) for the drive motor 66 can easily be adjusted to provide a desired dwell-time at each position of travel to provide for a selected period of display for each of the discrete images on the screen 24.

As rotation of the cam 86 continues counterclockwise, it will maintain contact with follower slide 100 of arm 32 while the cam surface 88 contacts the follower slide 96 of arm 30 to thereby drive arm 30 upward, as viewed in FIG. 9, to thereby drive the apertures 22 down so that the upper edge contacts the stop block 18. Since the cam 86 maintains contact with follower slide 100, as shown in FIG. 9, the stop blocks 18 maintain positive contact with the right edge of the apertures 22. As above, the rigid stem 104 and over-travel bracket 110 allows for some over-travel of the coupling arm 30 after the stop blocks 18 contact the upper edge of the apertures 22.

Figure 19:
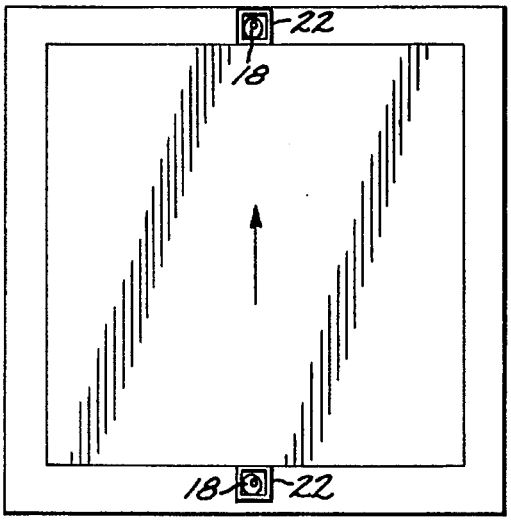

This sequence is continued as shown in FIGS. 10 and 11 where the cam 86 contacts follower slides 98 and 94, respectively, thereby driving the arms 30 and 32 and, consequently, the platen 20 first to the right and then to the top until stop blocks 18 contact edges of the apertures 22 impeding such movement (see FIGS. 18 and 19.

During shifting of the image screen relative to the mask, the stop blocks 18 and edges of apertures 22 always remain in positive registration to thereby ensure the dimensional stability of the platen and screen relative to the mask and precisely shift between aligned images. By positively maintaining at least one of the orthogonal edges of respective apertures 22 against the stop blocks 18, the alignment of the image screen relative to the mask is maintained to thereby permit the quick sequential display of images through rapid shifting of the platen. Such precise shifting is necessary where the rapid sequencing of images is used to convey the impression of animation.

Four distinct composite images may be selected from the image screen 24 for projection through the mask 26 in a timed sequence to be determined by the speed of the motor 66 as dictated by a timing circuit incorporated therewith. As described above, the positioning of the platen 20 and image screen 24 may be adjusted for a precise location of the mask 26. The stop blocks 18 serve to positively and repeatedly maintain precise positioning between the mask 26 and the screen 24 at the extreme four positions of the platen 20 as defined by the size of the apertures 22. All this is achieved with a minimum of power and in a relatively noise free fashion.

When new advertising is to be displayed, the image screen 24 may be easily replaced by first removing the bezel 34 and the mask 26 and then disengaging the screen 24. A new screen 24 may then be easily mounted on the platen 20 and the mask 26 and the bezel 34 replaced.

Figure 20:
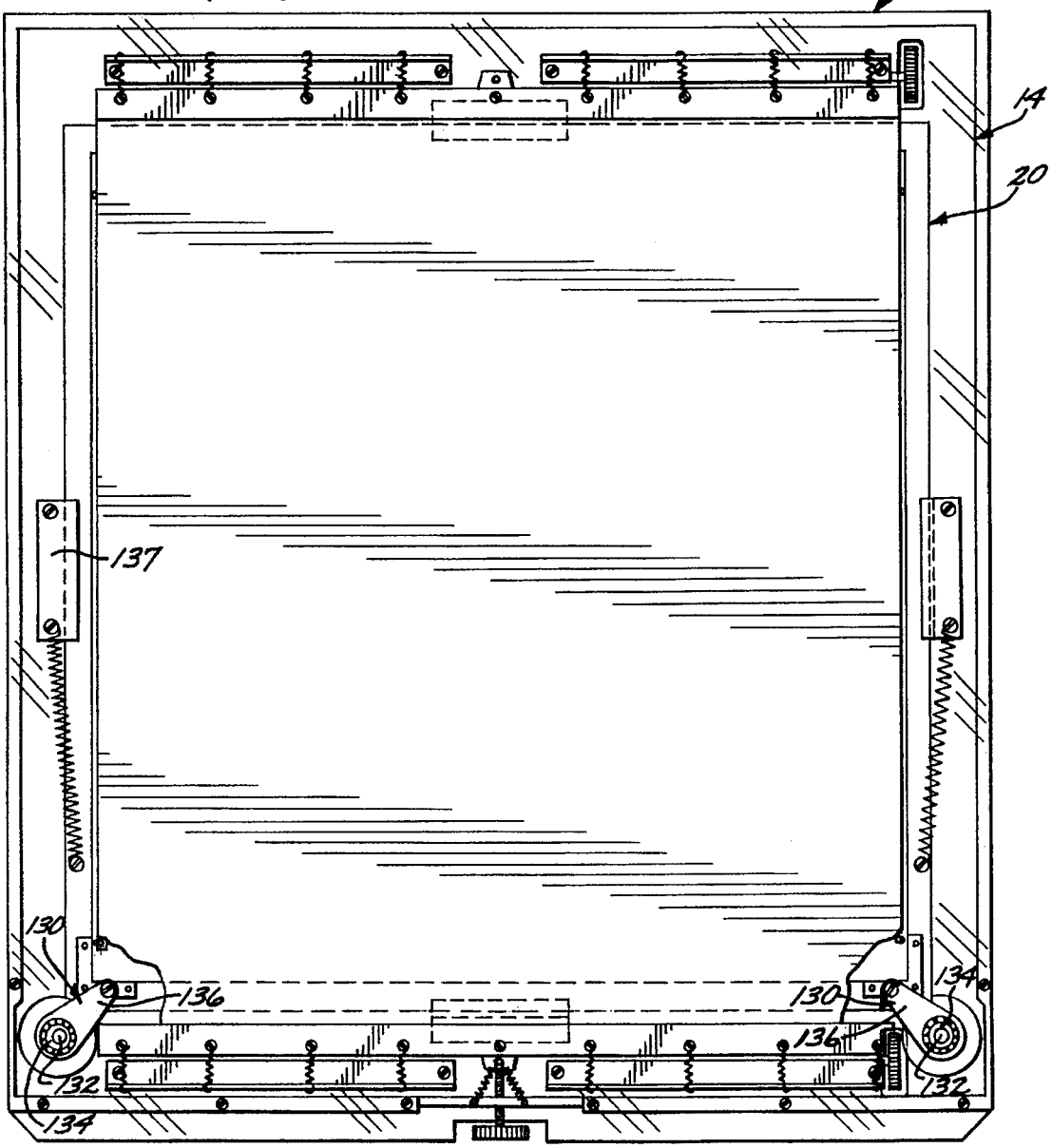
FIG. 20 is a view, partially cut away, showing a second embodiment of the present invention with the bezel removed.
Figure 21:
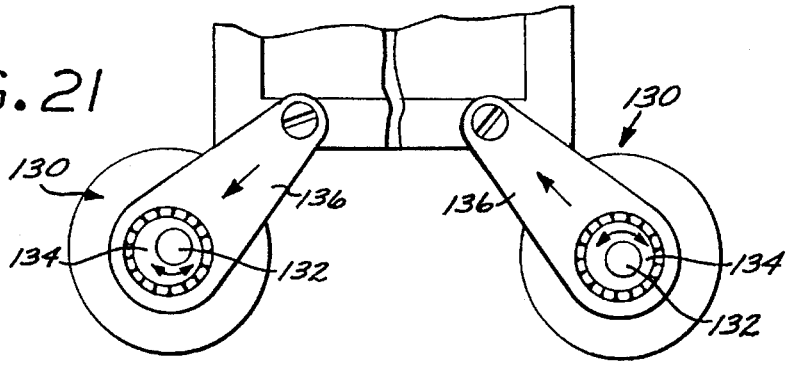
FIG. 21 is a view of the eccentric cams of the embodiment shown in FIG. 20.

A second embodiment of the present invention is shown in FIGS. 20 and 21. The second embodiment is similar to that shown and described above except that the housing 12 has a frame 14 upon which a platen 20 is movably mounted, similar to the platen 20 described above. However, this platen 20 has stops 137 which limit its movement by contacting the sides of the platen 20 and this platen 20 is driven by independent drive devices 130.

The drive devices 130 are similar in construction and each include a pivot pin 132 mounted to the frame 14. An eccentric cam ring 134 is carried on each pivot pin 132. A drive arm 136 is mounted to each cam ring 134 by means of roller bearings and is mounted to the platen 20. The drive devices 130 incorporate separate incremental drive motors which are connected in an electrical circuit such that the motors are rotated back and forth in sequence with a dwell time between each sequential operation of the respective motors.

Figure 24:
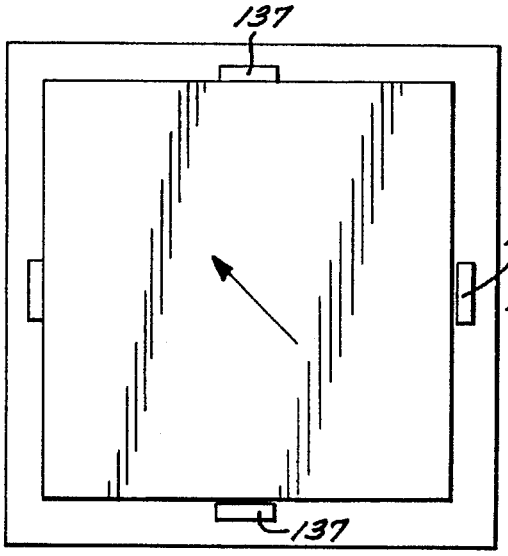
FIGS. 24–27 are diagrammatic views showing the platen of second and third embodiments in four different positions with respect to a frame.
Figure 25:
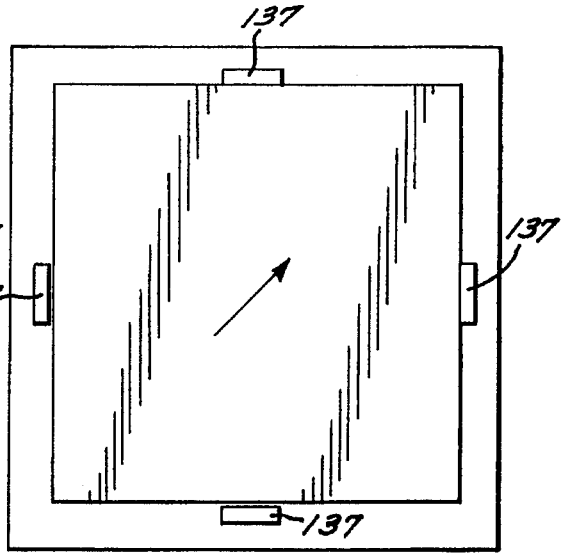
Figure 26:
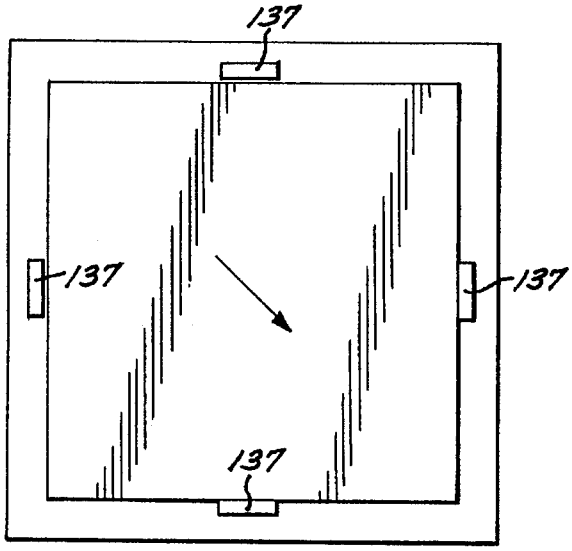
Figure 27:
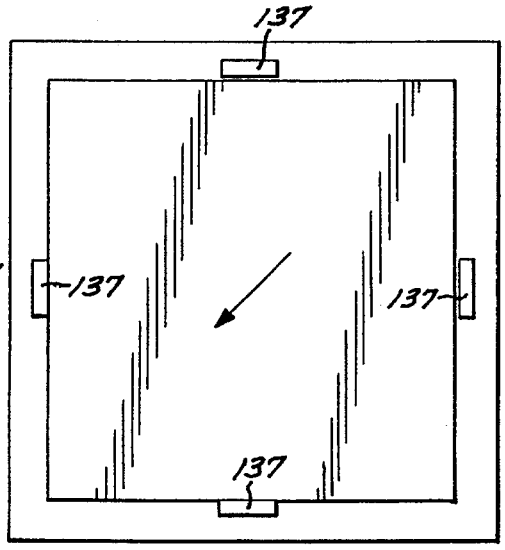

In operation, one of the drive devices 130 may be oscillated first. As the eccentric cam ring 134 of the drive device 130 rotates counterclockwise, the respective drive arm 136 will be driven upwardly to the right and will thereby drive the platen 20 upwardly to the right until it contacts stop blocks 137 at the top and right hand side of the frame 14 (FIG. 25). As rotation of the cam ring 134 is reversed, the platen 20 will be drawn downwardly to the left until it contacts stop blocks 137 at the bottom and left hand side of the frame 14 (FIG. 20). The other drive device 130 may then be actuated thereby driving its cam ring 134 while the other drive device 130 remains idle. Drive devices 130 drives the platen 20 upwardly to the left, as shown in FIG. 24, until it contacts stop blocks 137 at the top and left hand side of the frame 14. Reversal of the drive device 130 will draw the platen 20 downwardly to the right until it contacts stop blocks 137 at the bottom and right hand side of the frame 14 (FIG. 30). With this embodiment, the drive arms 136 positively move the platen 20 through a pattern to locations defined by the stop blocks 137 which dictate the four extreme positions in the pattern.

Figure 22:
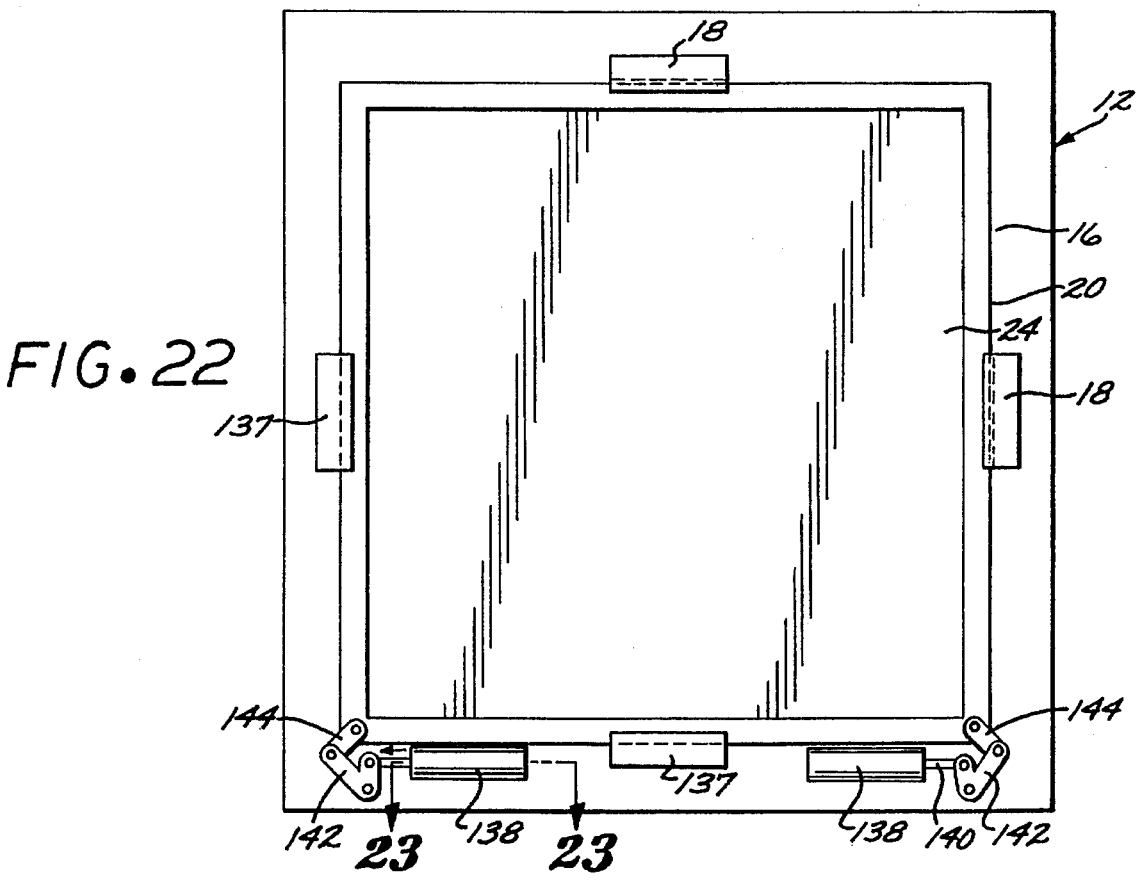
FIG. 22 is a view showing a third embodiment of the present invention with the bezel removed.
Figure 23:
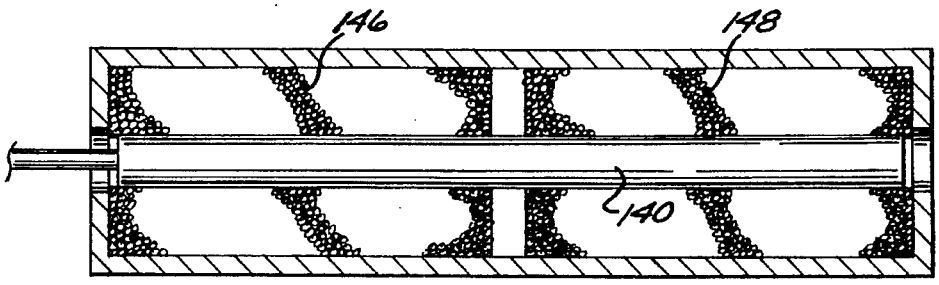
FIG. 23 is a cross sectional view taken along line 23—23 of FIG. 22.

A third embodiment of the present invention is shown in FIGS. 22 and 23. This embodiment includes, generally, a housing 12 formed with a track surface 16 for receipt of a platen 20. Mounted on the platen 20 is an image screen 24, comparable to the image screen 24, which is in underlying relationship to a mask (not shown) similar to the mask 26. The platen 20 is received between stop blocks 137 so as to provide a total of two (2) millimeters of travel in both the longitudinal and transverse directions similar to that described in the second embodiment above.

Mounted along the bottom side of the housing 12 is a pair of control solenoids 138 which have armatures 140 connected to pivotal bell cranks 142 which are coupled with the bottom corners of the platen 20 by means of links 144. Referring to FIG. 23, the solenoids 138 are each formed with a pair of coils 146 and 148 spaced along a central core 150 and coupled in an electrical circuit enabling energizing one coil to move it the other way. Movement of the core 150 directly moves the armature 140.

In operation, one of the coils 146 and 148 of the left solenoid 138, as shown in FIG. 22, may be energized to drive the core 150 and thereby the armature 140 to the left (as indicated by the arrow) thereby rotating the associated bell crank 142 counterclockwise to draw the associated link 144 and consequently the platen 20 downwardly to the left until the platen 20 engages the respective left hand and bottom stop blocks 137. By energizing the other coil 146 or 148, the core 150 and thereby the armature 140 is drawn to the right thereby rotating the bell crank 142 clockwise and driving the link 144 upwardly to the right until the platen 20 engages the top and right hand stop blocks 18. In a similar fashion, one of the coils 146 and 148 of the other solenoid 138 may be energized to drive the platen 20 upwardly to the left until the top and left hand stop blocks 137 are engaged. By energizing the other coil 146 or 148 of the solenoid 138, the platen 20 may be drawn downwardly and to the right to engage the bottom and right hand stop blocks 137.

From the foregoing, it will be apparent that the advertising display apparatus of the present invention provides a convenient and economical means for receiving and mounting different image screens in a manner which provides for sequential shifting of the image screen relative to a mask and a precise ordered relationship to provide for positive indexing of the positioning between the screen and mask for sequential display of various high quality images.

While embodiments of the present invention have been shown and described, various modifications may be made without departing from the scope of the present invention, and all such modifications and equivalents are intended to be covered.

What is claimed is:

1. An advertising display apparatus comprising:

a housing including a central window;

a mask mounted on said housing in confronting relation with said window;

stop blocks mounted on said housing;

an image screen bearing a plurality of images shiftable to a plurality of discrete positions relative to said mask to display at each said position one of said images;

a platen mounted in floating relationship on said housing behind said window for receiving said image screen and including a plurality of stop edges, one edge engageable with a respective one of said stop blocks at each of said discrete positions to positively stop movement of said platen in at least one direction relative to said housing;

mounting pins on said platen engageable with said image screen;

an eccentric drive device mounted on said housing and coupled with said platen to drive it through a predetermined path to carry said image screen mounted on said platen to said plurality of discrete positions to engage, at each of said positions, at least one of said edges with one of said respective stop blocks.

2. An advertising display apparatus as set forth in claim 1 wherein:

said platen includes at least one drive tab formed with a stop aperture configured with at least one edge defining one of said stop edges and wherein:

said stop block is in the form of a stop pin projecting into said stop aperture.

3. An advertising display apparatus as set forth in claim 1 wherein:

said platen includes elongated support structure configured with an arcuate convex support surface defining a raised longitudinal axis disposed centrally in said window for support of said image screen;

said image screen and said mask are flexible and said apparatus includes:

a spring for connection to said mask and arranged to tension said mask over said image screen to hold said image screen conformed to the shape of said support surface.

4. An advertising display apparatus as set forth in claim 3 wherein:

said support structure includes a convex undersurface and a flexible resilient platen plate on said convex undersurface and attached thereto along said raised longitudinal axis and free at its lateral opposite edges, said platen plate being configured to, when said spring tensions said connectors, draw said lateral opposite edges toward said convex undersurface.

5. An advertising display apparatus as set forth in claims wherein:

said drive device includes an eccentric cam mounted on said housing and orthogonal coupling arms coupled on their proximate ends with said cam and on the respective distal ends with adjacent sides of said platen.

6. An advertising display apparatus according to claim 5 wherein:

said stop blocks and stop edges are configured and sized relative to each other to limit movement of said platen a substantially square path.

7. An advertising display apparatus as set forth in claim 6 wherein:

said stop blocks and stop edges are configured to limit movement of said platen such that said square path is substantially one millimeter square.

8. An advertising display apparatus as set forth in claim 1 wherein:

said drive device includes inelastic coupling arms coupled to adjacent sides of said platen, said arms being formed with opposite ends and each including overtravel devices including springs biasing said opposite ends to respective normal positions and operative upon engagement of respective said stop blocks and stop edges to, upon application of a predetermined force, provide for movement of the respective opposite ends of said relative to one another.

9. An advertising display apparatus according to claim 1 wherein:

said platen includes drive pins mounted on adjacent sides thereof;

said drive device includes an eccentric driver mounted on said housing and a pair of rigid coupling arms coupled on their respective proximate ends to said eccentric driver, projecting orthogonally and formed at their respective distal ends with respective slots received over the respective said drive pins.

10. An advertising display apparatus according to claim 9 wherein:

said drive device includes pivot pins mounting the respective said coupling arms centrally from said housing.

11. An advertising display apparatus according to claim 10 wherein:

the respective said coupling arms are articulated and include overtravel springs biasing the respective arms to respective normal positions and operative upon actuation of said drive device to rotate the respective arms sufficiently far to engage the respective one of said edges with the respective said block to, upon further operation of said driver causing continued rotation of the respective said arm, provide for articulation of the respective said arm against the bias of said spring to allow for overtravel of the respective said arm.

12. An advertising display apparatus according to claim 11 wherein:

said control arms are formed at their respective proximate ends with respective drive windows including follower edges; and said driver includes a drive cam received in the respective said windows and rotatable to engage said stop edges.

13. An advertising display apparatus according to claim 12 wherein:

said driver includes low friction slides in the respective said drive windows to be engaged by said cam.

14. An advertising display apparatus according to claim 1 wherein:

said platen is formed with opposite sides and includes control tabs mounted on said opposite sides and formed with respective control windows configured with respective edges defining the respective said stop edges and wherein:

said stop blocks are in the form of a pair of stop pins mounted on said housing and projecting into the respective said control windows.

15. An advertising display apparatus according to claim 1 wherein:

said image screen includes at least four images arranged thereon in a predetermined square pattern;

said mask includes a grid arranged in said predetermined square pattern;

said platen includes said stop edges arranged and configured to engage a respective said stop block at each side of said square pattern; and said drive device drives said platen in said predetermined square pattern.

16. An advertising display apparatus comprising:

a housing including a central window;

a mask mounted on said housing in confronting relationship with said window;

stop blocks on said housing;

a platen mounted in floating relationship on said housing behind said window for travel through a predetermined exposure path having a plurality of discrete locations; mounting pins on said platen for mounting an image screen bearing a plurality of images on said platen for movement through said predetermined exposure path, said platen further including stop edges arranged and configured to, at each said discrete location, contact a respective one of said stop blocks to stop movement of said platen in at least one direction relative to said housing;

an eccentric drive device mounted on said housing and coupled with said platen to drive it through said predetermined path to said discrete locations.

17. An advertising display apparatus according to claim 16 that includes:

an image screen including said images and including index bores for engaging said mounting pins on said platen.

18. A method of displaying multiple advertising images including:

selecting an image screen bearing a plurality of images arranged in a predetermined pattern to define discrete positions associated with the respective images;

selecting a mask to overlie said screen such that shifting of said screen through a selected path to discrete positions corresponding with the positions of the respective images in said screen will, at the respective said discrete positions, display a respective said image;

selecting a display device of the type including a housing for mounting said mask and including stop blocks and further including a platen for supporting said screen and floatably mounted on said housing for travel through said selected path and including a plurality of stop edges engageable with respective one of said stop blocks at each of said discrete positions to stop travel of said platen in at least one direction;

mounting said screen on said platen; and repeatedly driving said platen through said selected path to the respective said discrete positions to repeatedly engage the said stop edges with the respective said stop block at the respective said discrete positions to thereby repeatedly display the respective images through said mask.

* * * * *